United States Patent [19]

Henzel et al.

[11] Patent Number: 4,927,744

[45] Date of Patent: May 22, 1990

[54] PHOTOGRAPHIC ELEMENT HAVING SOLID PARTICLE DISPERSION OXIDIZED DEVELOPER SCAVENGER

[75] Inventors: Richard P. Henzel, Webster; Paul L. Zengerle, Rochester, both of N.Y.

[73] Assignee: Eastman Kodak Company, Rochester, N.Y.

[21] Appl. No.: 229,372

[22] Filed: Aug. 5, 1988

[51] Int. Cl.[5] ..... G03C 1/42

[52] U.S. Cl. ..... 430/566; 430/214; 430/505; 430/551

[58] Field of Search ..... 430/214, 505, 551, 566

[56] References Cited

U.S. PATENT DOCUMENTS

| | | | |
|---|---|---|---|
| 2,728,659 | 12/1955 | Loria et al. | 430/551 |
| 3,700,453 | 10/1972 | Knechel | 430/505 |
| 4,366,236 | 12/1982 | Takabashi | 430/505 |
| 4,447,523 | 5/1984 | Ross et al. | 430/505 |
| 4,490,461 | 12/1984 | Webb et al. | 430/510 |
| 4,575,481 | 3/1986 | Takahashi et al. | 430/214 |
| 4,619,891 | 10/1986 | Takahashi | 430/505 |

*Primary Examiner*—Paul R. Michl
*Assistant Examiner*—Janet C. Baxter
*Attorney, Agent, or Firm*—Paul L. Marshall

[57] ABSTRACT

Photographic elements having an oxidized developer scavenger that is a solid particle dispersion of a hydroquinone derivative. The solid particle dispersion of the oxidized developer scavenger offers improved stability to oxidation compared to conventional dispersions of hydroquinone derivatives.

11 Claims, No Drawings

PHOTOGRAPHIC ELEMENT HAVING SOLID PARTICLE DISPERSION OXIDIZED DEVELOPER SCAVENGER

FIELD OF THE INVENTION

This invention relates to photography and in particular to the use of oxidized developer scavengers in photographic elements.

BACKGROUND OF THE INVENTION

Photographic elements generally form images through a reaction in which a developer reduces exposed silver halide to metallic silver. The oxidized developer then often reacts with a coupler that forms or releases an image-forming dye or other photographically useful groups; however, unwanted reactions between oxidized developer and components of the photographic element can cause adverse effects, such as dye stain. For example, in a multilayer color photographic element, a different color dye image is formed in each layer by the reaction of oxidized developer in that layer with a dye-forming coupler. Aerial oxidation of developer can cause reaction with dye-forming coupler where no silver development has taken place, leading to unwanted dye stain. Also, migration of oxidized developer from one layer to another can cause color contamination of one layer with image information from another layer, adversely effecting image reproduction.

In order to minimize unwanted reactions between oxidized developer and components of the photographic element, oxidized developer scavengers are used. These scavengers are incorporated in photographic elements in locations, such as interlayers, to prevent or reduce the reaction of oxidized developer with components in the element.

Hydroquinone derivatives have been widely used as oxidized developer scavengers. Such compounds are described, for example, in U.S. Pat. Nos. 2,728,659, 3,700,453, 3,982,944, and 4,366,236. They generally do not wander in the photographic element and provide effective scavenging of oxidized developer. The art teaches these scavengers may be incorporated in photographic elements as "oil in water dispersions". By this it is meant that the scavenger compounds are dissolved in a solvent, which is dispersed as fine droplets in an aqueous gelatin solution, and then coated as a layer of a photographic element.

While hydroquinone derivatives are generally effective as oxidized developer scavengers, they tend themselves to be oxidized by atmospheric oxygen. When photographic elements containing hydroquinone scavengers are stored for periods of time, the effectiveness of the scavenger can be reduced by aerial oxidation.

SUMMARY OF THE INVENTION

It has now been found that if hydroquinone derivative oxidized developer scavengers are incorporated in a photographic element in the form of a solid particle dispersion, their stability to oxidation is significantly increased compared to conventional dispersions.

The present invention provides for a photographic element comprising a support having thereon at least one silver halide emulsion layer, and a layer, which is the same or different from the silver halide layer, comprising a binder and a solid particle dispersion of a hydroquinone derivative.

In another embodiment, the invention provides for a process for incorporating a hydroquinone derivative oxidized developer scavenger in a layer of a photographic element, comprising the steps of: (1) dispersing solid particles of the hydroquinone in an aqueous medium comprising a binder, and (2) coating the resulting dispersion as a layer on a support.

DESCRIPTION OF THE PREFERRED EMBODIMENTS

The hydroquinone derivative oxidized developer scavengers useful in the practice of the invention are well-known in the art. Useful hydroquinone derivatives are described in U.S. Pat. Nos. 2,336,327, 2,360,290, 2,403,721, 2,728,659, 3,700,453, 3,982,944, and 4,366,236, the disclosures of which are incorporated herein by reference. The scavenger compounds should be solid and substantially insoluble in water at coating conditions, which may involve temperatures of from 10° to 50° C. and pH of 5.0 to 7.0.

These and other hydroquinone derivatives that can be used in accordance with this invention are represented by the formulas (I) to (VI) below:

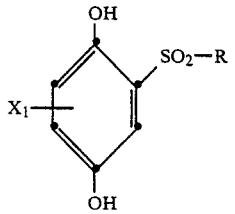

(I)

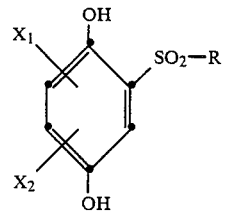

(II)

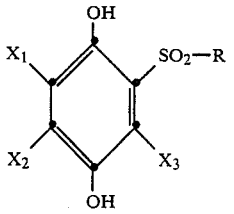

(III)

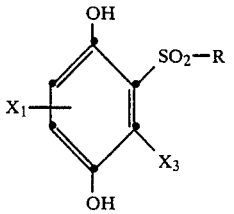

(IV)

-continued (V)

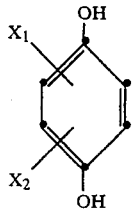

(VI)

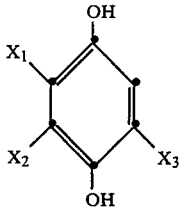

where $X_1$, $X_2$ and $X_3$, which may be the same or different, each represents a halogen atom (e.g., chlorine atom, bromine atom, etc.); an aliphatic group such as an alkyl group having 1 to 22 carbon atoms (e.g., straight chain or branched alkyl groups as methyl group, ethyl group, n-propyl group, isopropyl group, n-butyl group, tert-butyl group, n-pentyl group, n-decyl group, tert-decyl group, n-dodecyl group, sec-dodecyl group, tert-dodecyl group, n-pentadecyl group, sec-pentadecyl group, tert-pentadecyl group, sec-octadecyl group, tert-octadecyl group, etc.), a substituted alkyl group having 1 to 22 total carbon atoms, the substituent being a halogen atom (chlorine atom, bromine atom, etc.), a hydroxy group, an alkoxy group, a substituted amino group (including alkyl- or arylsulfamoyl group and alkyl- or arylcarbamoyl group), a cyano group, etc. (e.g., 4-chlorobutyl group, 2-hydroxyethyl group, 3-methoxypropyl group, 3-n-butylsulfamoylpropyl group, etc.), an alkenyl group having 3 to 22 carbon atoms (e.g., allyl group, etc.), a cycloalkyl group having 5 to 12 carbon atoms (e.g., cyclohexyl group, etc.), and an aralkyl group having 7 to 22 carbon atoms (e.g., benzyl group, phenethyl group, 4-methylphenylethyl group, etc.); an aryl group having 6 to 22 carbon atoms (in total) (e.g., phenyl group, phenyl group substituted by alkylsulfonyl group or arylsulfonyl group, etc.); an alkoxy group such as an alkoxy group having 1 to 22 carbon atoms, which may have been substituted (e.g., methoxy group, ethoxy group, n-butoxy group, n-dodecyloxy group, etc.); an aryloxy group such as an aryloxy group having 6 to 22 carbon atoms, which may be substituted (e.g., phenoxy group, 4-n-butoxyphenyloxy group, etc.); an alkylthio group such as an alkylthio group having 1 to 22 carbon atoms, which may be substituted (e.g., methylthio group, ethylthio group, n-pentylthio group, n-dodecylthio group, n-pentadecylthio group, 5-chloropentylthio group, etc.); or an arylthio group such as an arylthio group having 6 to 22 carbon atoms, which may be substituted (e.g., phenylthio group, 4-nitrophenylthio group, etc.). $X_1$ and $X_2$ may also form together with each other a condensed ring, preferably a 5- to 7-membered ring (e.g., cyclopentane ring, cyclohexane ring, cyclohexadiene ring, norbornene ring, etc.). R represents an aliphatic group as described above for $X_1$, $X_2$, and $X_3$.

Examples of useful hydroquinone derivative oxidized developer scavenger compounds include:

1

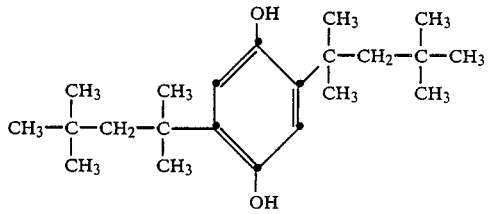

2

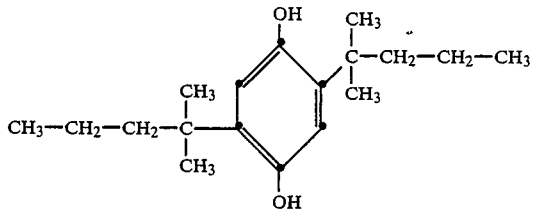

3

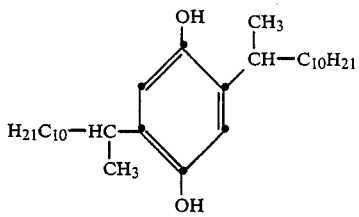

4.

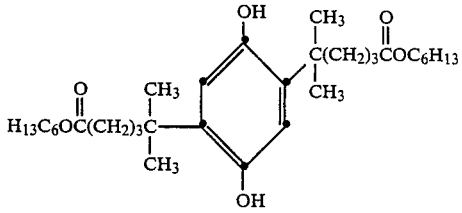

5.

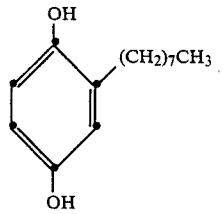

6.

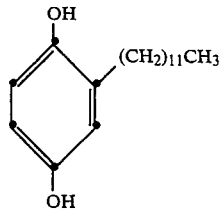

7.

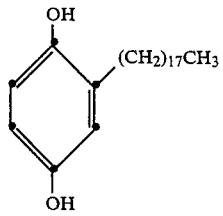

-continued
8.
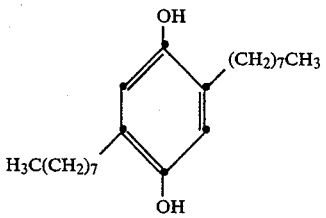
9.
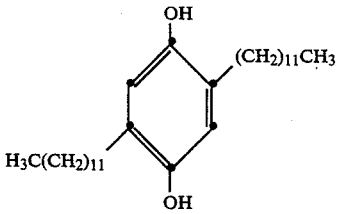
10.
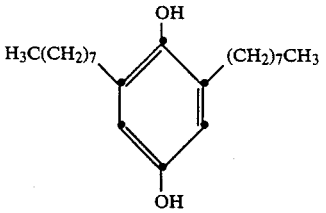
11.
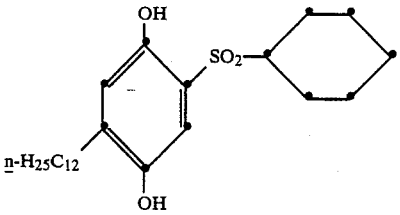
12.
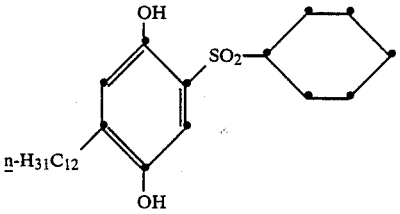
13.
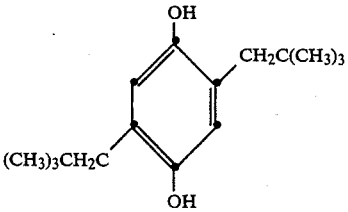
14.
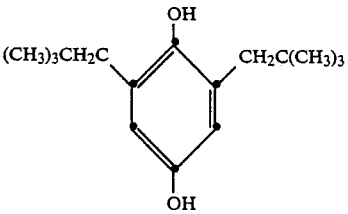
-continued
15.
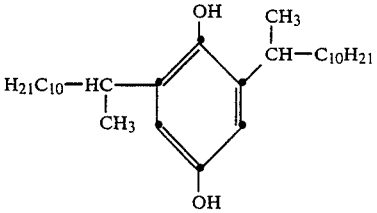
16.
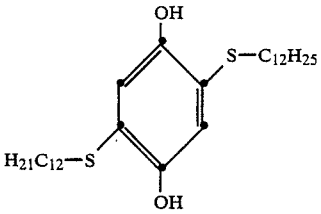
17.
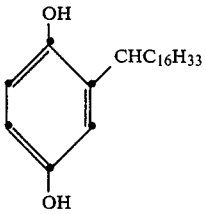
18.
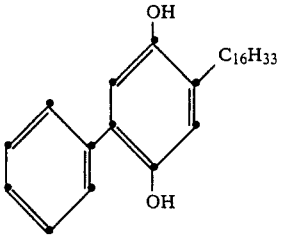
19.
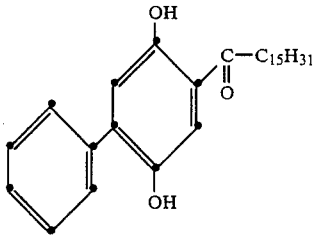
20.
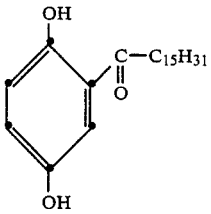
21.
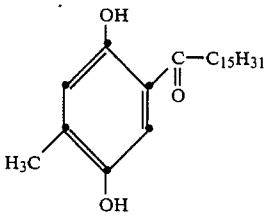

-continued

22.

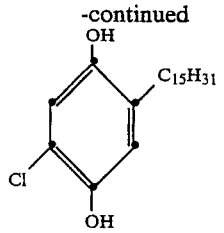

23.

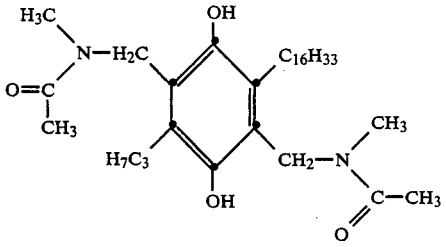

24.

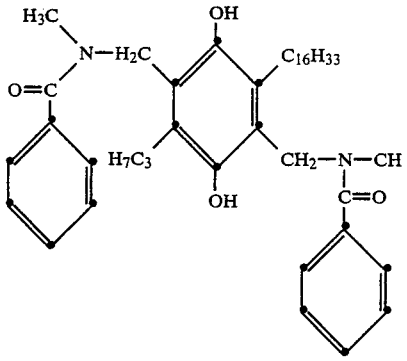

25.

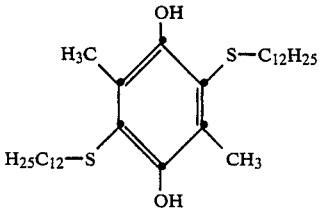

26.

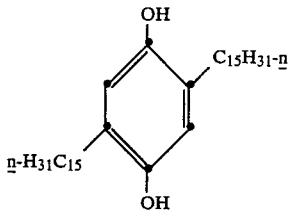

27.

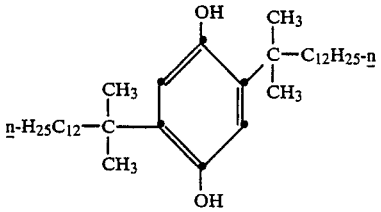

(all alkyl groups are n-alkyl unless specified otherwise)

In a preferred embodiment of the invention, the hydroquinone derivative has substituted or unsubstituted alkyl substituents of from 1 to 22 carbon atoms each, that are meta or para to each other on the hydroquinone phenyl ring. Examples of unsubstituted alkyl substituents include straight chain or branched alkyl groups as methyl group, ethyl group, n-propyl group, isopropyl group, n-butyl group, tert-butyl group, n-pentyl group, n-decyl group, tert-decyl group, n-dodecyl group, sec-dodecyl group, tert-dodecyl group, n-pentadecyl group, sec-pentadecyl group, tert-pentadecyl group, sec-octadecyl group, tert-octadecyl group, etc.). The alkyl groups may be substituted with, for example, a halogen atom (chlorine atom, bromine atom, etc.), a hydroxy group, an alkoxy group, a substituted amino group (including alkyl- or arylsulfamoyl group and alkyl- or arylcarbamoyl group), a cyano group, etc. (e.g., 4-chlorobutyl group, 2-hydroxyethyl group, 3-methoxypropyl group, 3-n-butylsulfamoylpropyl group, etc.), an alkenyl group having 3 to 22 carbon atoms (e.g., allyl group, etc.), a cycloalkyl group having 5 to 12 carbon atoms (e.g., cyclohexyl group, etc.), and an aralkyl group having 7 to 22 carbon atoms (e.g., benzyl group, phenethyl group, 4-methylphenylethyl group, etc.).

The hydroquinone derivatives useful in the present invention can be prepared by synthesis techniques well-known in the art. Synthesis of these compounds is described in U.S. Pat. Nos. 2,728,659, 3,700,453, 3,982,944, and 4,366,236, the disclosures of which are incorporated herein by reference.

The solid particle dispersion can be formed by precipitating or by reprecipitating the dye in the form of a dispersion in the presence of one or more dispersing agents, or by well-known milling techniques. Examples of such milling techniques include ball-milling, sand-milling, or colloid-milling the solid scavenger in the presence of a dispersing agent. Reprecipitating techniques by dissolving the scavenger and precipitating by changing the solvent and/or pH in the presence of a dispersing agent are well-known in the art. Milling techniques are well-known in the art and are described, for example, in U.S. Pat. No. 4,006,025, the disclosure of which is incorporated herein by reference. The scavenger particles in the dispersion should have mean diameters of from 0.01 μm to 10.0 μm and preferably from 0.05 μm to 5.0 μm.

The scavenger compounds can be used in the ways and for the purposes that scavengers for oxidized developing agent are employed in the art. They can be incorporated in a silver halide emulsion layer of the photographic element or in a separate layer of the element. When incorporated in a separate layer, that layer is preferably an interlayer between silver halide emulsion layers although it can be an undercoat layer coated below all of the silver halide emulsion layers or an overcoat layer coated above all of the silver halide emulsion layers. When the hydroquinone derivative is in a layer between two silver halide layers, the two silver halide layers preferably comprise a coupler that can react with oxidized developer such as a color developer to form or release a photographically useful group. Such photographically useful groups are known in the art and may be groups such as dyes, development modifiers such as development inhibitors, and the like.

The amount of scavenger compound employed will depend upon the particular purpose for which the scavenger is to be used and the degree of scavenging desired. Typically useful results are obtained when the scavenger is employed in an amount of between about 5 and 1000 mg/sq. meter per layer.

The vehicle for the solid particle dispersion can be essentially any of the known photographic vehicles, such as gelatin and other hydrophilic colloids, or various synthetic polymers such as polyvinyl alcohol or acrylamide polymers, commonly employed in silver halide photographic elements. These vehicles are described in *Research Disclosure*, December 1978, Item No. 17643, Section IX, the disclosure of which is incorporated herein by reference.

The photographic elements of the present invention can be simple black-and-white or monochrome elements comprising a support bearing a layer of the silver halide emulsion, or they can be multi-layer and/or multicolor elements. They can be designed for processing with separate solutions or for in-camera processing. Multicolor elements contain dye image forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsion or emulsions can be disposed as one or more segmented layers, e.g., as by the use of microvessels or microcells, as described in Whitmore U.S. patent application Ser. No. 184,714 filed September 9, 1980.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material, the element containing a scavenger of this invention. Preferably the scavenger is in an interlayer between silver halide emulsion layers sensitive to different regions of the visible spectrum although it can be in a silver halide emulsion layer or in an interlayer between silver halide emulsion layers sensitive to the same region of the visible spectrum.

The elements of the present invention can contain additional layers conventional in photographic elements, such as overcoat layers, spacer layers, filter layers, antihalation layers, pH lowering layers (sometimes referred to as acid layers and neutralizing layers), timing layers, opaque reflecting layer, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure*, December 1978, Item 17643, referred to above.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide, and mixtures thereof. The emulsions can be negative working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure*, Item 17643, December, 1978 and the references listed therein.

The photographic silver halide emulsions can contain other addenda conventional in the photographic art. Useful addenda are described, for example, in *Research Disclosure*, December 1978, Item 17643. Useful addenda include spectral sensitizing dyes and desensitizers, antifoggants, masking couplers, DIR couplers, DIR compounds, anti-stain agents, image dye stabilizers, absorbing materials such as filter dyes and UV absorbers, light scattering materials, coating aids, plasticizers and lubricants, and the like.

Depending upon the dye image-providing material employed in the photographic element, it can be incorporated in the silver halide emulsion layer or in a separate layer associated with the emulsion layer. The dye image-providing material can be any of a number known in the art, such as dye-forming couplers, bleachable dyes, dye developers and redox dye-releasers, and the particular one employed will depend on the nature of the element and the type of image desired.

Dye image-providing materials employed with conventional color materials designed for processing with separate solutions are preferably dye-forming couplers; i.e., compounds which couple with oxidized developing agent to form a dye. Preferred couplers which form cyan dye images are phenols and napthols. Preferred couplers which form magenta dye images are pyrazolones and pyrazolotriazoles. Preferred couplers which form yellow dye images are benzoylacetanilides and pivalylacetanilides.

Dye image-providing materials useful in diffusion transfer film units contain a dye moiety and a monitoring moiety. The monitoring moiety, in the presence of an alkaline processing solution and as a function of silver halide development, is responsible for a change in mobility of the dye moiety. These dye image-providing materials can be initially mobile and rendered immobile as a function of silver halide development, as described in U.S. Pat. No. 2,983,606. Alternatively, they can be initially immobile and rendered mobile, in the presence of an alkaline processing solution, as a function of silver halide development. This latter class of materials include redox dye-releasing compounds. In such compounds, the monitoring group is a carrier from which the dye is released as a direct function of silver halide development or as an inverse function of silver halide development. Compounds which release dye as a direct function of silver halide development are referred to as negative-working release compounds, while compounds which release dye as an inverse function of silver halide development are referred to as positive-working release compounds.

The developing agents that can be used to develop the photographic elements of this invention, the oxidized form of which can be reduced by the scavengers of this invention, include hydroquinones, aminophenols, 3-pyrazolidones and phenylene diamines. Some of these developing agents, when used for certain applications, are referred to in the art as electron transfer agents. The particular developing agent employed will depend on the particular type of photographic element to be processed. For example, phenylene diamines are the developers of choice for use with color photographic elements containing dye-forming couplers, while 3-pyrazolidones are preferably used with image transfer materials containing redox dye releasers.

Representative developing agents include: hydroquinone, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, N,N-diethyl-p-phenylenediamine, 3-methyl-N,N-diethyl-p-phenylenediamine, 3-methoxy-N,N-diethyl-p-phenylenediamine, N,N,N',N'-tetramethyl-p-phenylenediamine.

The following examples further illustrate this invention.

Preparation 1- Preparation of a Solid Particle Dispersion of Compound 1

150 g of the hydroquinone derivative compound was placed in a 2500 ml bottle containing 740 ml water, 34.2 g Aerosol OT®, and 4325 g of 2 mm zirconia beads, and ball-milled for 7 days at 68 rpm. The resulting dispersion was mixed with a melt of gelatin and water to yield a solution having dispersion having 6% compound and 6% gelatin.

Examples 1–4 - Photographic Evaluation

To evaluate the solid particle dispersions of compounds 1–4, dispersions of each of the compounds was prepared as described for Preparation 1 above and coated as interlayer scavengers for oxidized color developing agents in a color negative test format represented by the following schematic structure:

| Overcoat | Gelatin 0.86 g/m$^2$, Hardener 1.75% | |
|---|---|---|
| Causing Layer: | Silver Halide | 1.61 g/m$^2$ |
| | Yellow Coupler | 0.34 g/m$^2$ |
| | Gelatin | 2.42 g/m$^2$ |
| Interlayer: | Test Compound | 0.484 mmol/m$^2$ |
| | Gelatin | 0.62 g/m$^2$ |
| Receiving Layer: | Cyan Coupler | 1.12 g/m$^2$ |
| | Gelatin | 2.42 g/m$^2$ |
| | Film Support | |

In this element the hardener is bis(vinylsulfonylmethyl)ether and the couplers have the following structures:

Yellow Coupler:

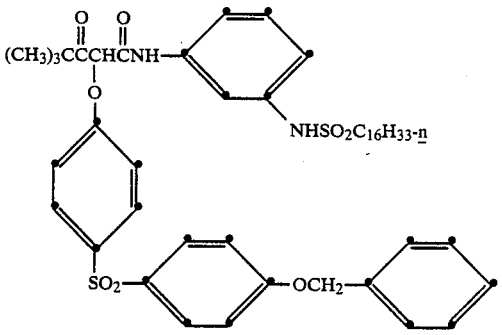

Cyan Coupler:

-continued

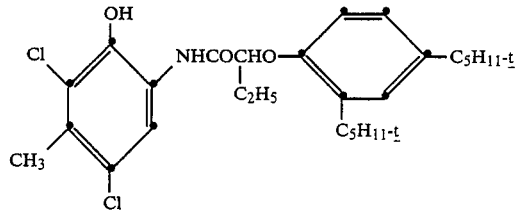

Couplers were coated as dispersions in dibutylphthalate or comparable coupler solvent. As a comparison, compounds 1–4 were also coated as oil in water dispersions with dibutylphthalate. In this system, oxidized color developer, originating in the causing layer as the exposed silver halide develops, can react with the yellow coupler to form a yellow dye. It can also migrate through the interlayer to the receiving layer to react with coupler there to form a cyan dye.

Scavenging efficiency of each test compound can be determined by measuring the developed density of cyan dye (at 650 nm). In this system, the only way to generate cyan dye is for oxidized color developer to diffuse from the yellow causing layer through the interlayer into the cyan receiving layer because there is no silver halide in the cyan layer to generate oxidized developer. The amount of color contamination allowed by the interlayer is indicated by the amount of cyan dye formed, and is measured by the status M red density at D-max. The amount of red density is inversely related to the concentration of scavenger in the coating before development. Stability of oxidized developer scavengers can be determined by exposing and processing identical elements both before and after incubation.

The rate of scavenger oxidation observed during normal film keeping conditions can be accelerated, for example, by increasing the temperature, humidity, or partial pressure of oxygen in the test system. One such accelerated keeping test is described in Example 3 of U.S. Pat. No. 4,205,987.

One sample of each of the photosensitive elements, prepared as described above to contain a different desired test compound, was exposed through a graduated density test object and then processed with a Kodak C-41® process as described in the *British Journal of Photography*, July 12, 1974, pp. 597–8. A second sample of each element was incubated in an accelerated keeping test and then exposed and processed in the same way as the fresh samples. The cyan dye contamination (red density) was then measured for the samples, both fresh and incubated. The results are presented in the following table.

TABLE I

| Scavenger Compound | Status M Red Density | |
|---|---|---|
| | Fresh | Incubated |
| None (Control) | 0.32 | 0.32 |
| 1 (Comp. Disp.) | 0.08 | 0.27 |
| 1 (SPD - Invention) | 0.15 | 0.15 |
| 2 (Comp. Disp.) | 0.11 | 0.28 |
| 2 (SPD - Invention) | 0.17 | 0.17 |
| 3 (Comp. Disp.) | 0.07 | 0.19 |
| 3 (SPD - Invention) | 0.18 | 0.18 |
| 4 (Comp. Disp.) | 0.12 | 0.26 |
| 4 (SPD - Invention) | 0.19 | 0.10 |

SPD - Solid Particle Dispersion according to the invention
Comp. Disp. - Comparison dispersion in dibutyl phthalate It can be seen from the above table that the solid particle dispersions of the oxidized developer scavengers had greater scavenging activity after incubation and greater stability to incubation than the corresponding comparison solvent dispersions.

The invention has been described in detail with particular reference to preferred embodiments thereof, but it will be understood that variations and modifications can be effected within the spirit and scope of the invention.

What is claimed is:

1. A photographic element comprising a support having thereon at least one silver halide emulsion layer, and a layer, which is the same or different from the silver halide layer, comprising solid particles dispersed in a vehicle, said particles consisting essentially of a hydroquinone derivative.

2. A photographic element according to claim 1 wherein the solid particles of oxidized developer scavenger have mean diameters ranging from 0.01 to 10.0 μm.

3. A photographic element according to claim 1 wherein the vehicle is a hydrophilic colloid.

4. A photographic element according to claim 3 wherein the hydrophilic colloid is gelatin.

5. A photographic element according to claim 1 further comprising a second silver halide emulsion layer and wherein the oxidized developer scavenger layer is between the two silver halide layers.

6. A photographic element according to claim 5 wherein the silver halide layers each comprise a coupler that can react with oxidized developer to form or release a photographically useful group.

7. A photographic element according to claim 1 wherein the hydroquinone derivative comprises two alkyl ballast groups, para to each other, having from 1 to 22 carbon atoms each.

8. A photographic element according to claim 1 wherein the hydroquinone derivative comprises two alkyl ballast groups, meta to each other, having from 1 to 22 carbon atoms each.

9. A process for incorporating a hydroquinone derivative oxidized developer scavenger in a layer of a photographic element, comprising the steps of:

dispersing solid particles consisting essentially of the hydroquinone in an aqueous medium comprising a binder, and coating the resulting dispersion as a layer on a support.

10. A process according to claim 9 wherein the solid particles are dispersed in the medium by milling.

11. A process according to claim 9 wherein the binder is a hydrophilic colloid.

* * * * *